US005849392A

United States Patent [19]

Hamada et al.

[11] Patent Number: 5,849,392

[45] **Date of Patent: *Dec. 15, 1998**

[54] THREAD WOUND GOLF BALL

[75] Inventors: Akihiko Hamada, Kakogawa; Akira Kato, Kobe; Keiji Moriyama, Akashi; Kuniyasu Horiuchi, Kobe; Tadahiro Ebisuno, Nishinomiya, all of Japan

[73] Assignee: Sumitomo Rubber Industries, Ltd., Hyogo-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 71,985

[22] Filed: Jun. 7, 1993

[30] Foreign Application Priority Data

Jun. 9, 1992 [JP] Japan ..... 4-149304

[51] Int. Cl.[6] ..... A63B 37/06

[52] U.S. Cl. ..... 428/159; 428/220; 428/300.7; 428/319.3; 428/319.9; 525/193; 525/236; 525/237; 525/315

[58] Field of Search ..... 525/193, 236, 525/237, 315; 428/159, 220, 300.7, 319.3, 319.9

[56] References Cited

U.S. PATENT DOCUMENTS

| | | | |
|---|---|---|---|
| 4,321,183 | 3/1982 | Cox et al. | 524/423 |
| 4,429,068 | 1/1984 | Nakahira | 524/302 |
| 5,033,748 | 7/1991 | Ebisuno | 273/218 |
| 5,215,308 | 6/1993 | Hiraoka et al. | 525/193 |

FOREIGN PATENT DOCUMENTS

| | | |
|---|---|---|
| 2164260 | 3/1986 | United Kingdom . |

*Primary Examiner*—Cecilia J. Tsang
*Assistant Examiner*—Patrick R. Delaney
*Attorney, Agent, or Firm*—Birch, Stewart, Kolasch & Birch LLP

[57] ABSTRACT

The present invention provides a thread wound golf ball having improved flight performances, which comprises a solid center, a thread layer and an outer cover. The solid center is formed from a rubber component with crosslinked structure which contains an oily substance. Impact resilience of the solid center is 90 cm or more.

7 Claims, No Drawings

THREAD WOUND GOLF BALL

FIELD OF THE INVENTION

The present invention relates to a thread wound golf ball. More particularly, it relates to a thread wound golf ball having improved flight performance.

BACKGROUND OF THE INVENTION

A thread wound golf ball comprising a center, a thread rubber layer and an outer cover has excellent control properties and hit feeling. Although the thread wound golf ball is often used by a golfer (particularly, a senior golfer), its flying distance is inferior compared to that of a two piece golf ball and improvement in flying distance has been sought.

The center for the thread wound golf ball can be generally classified into two types. One is a solid center which is formed from a vulcanized rubber of high-cis polybutadiene, and the other is a liquid center wherein a solution or water paste is encapsulated in a hollow rubber center. It is known that flight performance of the golf ball is significantly influenced by the properties of the center. The golf ball having a conventional solid center is liable to easily cause excessive spin, and is inferior in flying distance when hit with an iron club.

On the other hand, the golf ball having a liquid center suppresses the formation of spin and is superior in flying distance when hit with an iron club. However, when hit with a wood club, the ball is liable to fly like a drop ball, which results in poor flying distance. Accordingly, either center imparts both merits and demerits in the flight performance of golf balls, and neither satisfies flight performances required for the golf balls.

Further, regarding the liquid center, the production process is complicated. Also, there is a safety problem, for example, when a ball is cut, a liquid is sprayed at high speed and may hit eyes, which results in injury of eye balls. In order to solve the problem, various trials have hitherto been made [e.g. Japanese Patent Kokai Nos. 60-168471 and 60-72573 (enlargement of a diameter of a solid center), No. 62-181070 (solid fragment is encapsulated in a liquid center to decrease formation of spin), No. 60-165966 (water-containing polymer is used for a liquid center to enhance safety), etc.]. However, these modifications are also insufficient and further improvement of the thread wound golf ball is demanded.

SUMMARY OF THE INVENTION

In order to solve a problem of the conventional thread wound golf ball on flight performances, the present inventors have intensively studied. As a result, it has been found that, by using a solid rubber having a crosslinked structure and containing an oily substance as the center for the thread wound golf ball, the formation of spin is suppressed at a suitable initial velocity and hitting angle is increased, which results in good balance between hitting with a wood and iron club, and the present invention has been completed.

The main object of the present invention is to provide a thread wound golf ball having improved flight performance.

This object, as well as other objects and advantages of the present invention will become apparent to those skilled in the art from the following description.

According to the present invention, there is provided a thread wound golf ball comprising a solid center, a thread rubber layer and an outer cover, wherein the solid center has impact resilience of 90 cm or more and is formed from a rubber component with crosslinked structure which contains an oily substance.

In the thread wound golf ball of the present invention, there is no safety problems associated with a liquid center because a solid center is used.

DETAILED DESCRIPTION OF THE INVENTION

The rubber for the solid center may be any rubber which can be vulcanized with sulfur or peroxide, for example, polybutadiene rubber (BR), natural rubber (NR), ethylene-propylene-diene monomer (EPDM) terpolymer rubber, polynorbornene rubber. Styrene-type, ethylene-type or urethane-type thermoplastic rubber can be also used. In all cases, it is preferred that the rubber is superior in compatibility with the below-mentioned oily substance and can contain a large amount of the oily substances, and has a suitable impact resilience when crosslinked under conditions where the oily substance is uniformly dispersed in the rubber.

The oily substance is one which has fluidity or exhibits a semisolid state at room temperature and which contains little volatility. Particularly preferred are oily substances which are superior in compatibility with the above rubber and can be uniformly admixed in a rubber without remarkable deterioration of impact resilience of the rubber, or which can apply suitable impact resilience to the rubber having low impact resilience by mixing. Examples of the oily substance are as follows.

(1) Petroleum oil, which is often used as an extending oil for the rubber and is classified into the following groups according to whether the oil contains an aromatic, naphthene or paraffin ring;

(i) Paraffinic oil containing at least 50% of paraffin chain (ii) Naphthenic oil containing 30 to 45% of naphthene ring carbon (iii) Aromatic oil containing at least 35% of aromatic carbon (2) Plasticizer, such as phthalate polyester (e.g. Dibutyl phthalate (DBP), Dioctyl phthalate (DOP), etc.), adipate polyester (e.g. Dioctyl adipate (DOA), etc.), sebacate polyester (e.g. Dioctyl sebacate (DOS), etc.), phosphate polyester (e.g. Tricresyl phosphate (TCP), etc) and the like;

(3) Factice which is obtained by vulcanizing a vegetable oil with sulfur or sulfur chloride (e.g. semi-translucent factice, black factice, brown factice, etc.);

(4) Alkylbenzene, such as 1-dodecyl-4-hexylbenzene, 1-dodecyl-3-hexylbenzene, 1,3,5-mesitylene, 1,2,3-hemimellitene, etc.;

(5) Liquid rubber, such as liquid polybutadiene, liquid polyisoprene and the like.

These oily substances are used alone or in combination thereof.

The combination of the oily substance with the base rubber is decided by taking compatibility of the oily substance with the rubber into consideration. Typical examples of suitable combinations include polybutadiene rubber or natural rubber with naphthenic oil or aromatic oil; EPDM with paraffin oil; polynorbornene rubber with naphthenic oil, aromatic oil, plasticizer, alkylbenzene, paraffinic oil; urethane rubber with plasticizer or factice and the like.

The amount of the oily substance formulated is preferably about 30 to 500 parts by weight, more preferably 50 to 400 parts by weight, based on 100 parts by weight of the rubber. When the amount is smaller than 30 parts by weight, no improvement effect is obtained. When the amount is larger than 500 parts by weight, sometimes, an oil can not be admixed in the rubber according to the combination.

To the solid center in the present invention, filler can be added as a specific gravity modifier (e.g. barium sulfate, etc.), reinforcer (e.g. water-containing silicic acid, carbon black, etc.), processing aid as a tackifier, antioxidant and the like, in addition to the base rubber and oily substance. In the case of sulfur vulcanization, sulfur, zinc oxide, stearic acid, vulcanization accelerator and zinc stearate are added as a vulcanizing chemical and, in the case of peroxide vulcanization, peroxide (e.g. dicumyl peroxide, 1,1-di-t-butylperoxy-3,3,5-trimethylolcyclohexane, etc.), activator (e.g. zinc stearate, etc.), zinc oxide and co-crosslinking agent (e.g. zinc acrylate, zinc methacrylate, N,N'-m-phenylenedimaleimide, etc.) are added in a suitable amount to form a vulcanizable rubber composition.

In the present invention, the rubber composition thus obtained is molded (vulcanized) in a mold by compression molding or injection molding to give a rubber center having a predetermined dimension. The outer diameter of the rubber center thus obtained is 23 to 34 mm, preferably 26 to 32 mm. When the outer diameter is smaller than 23 mm, the formation of spin becomes large and launch angle becomes small, whereby, the flying distance is not improved. On the other hand, when the outer diameter is larger than 34 mm, the thread rubber layer becomes too thin and, therefore, a predetermined hardness can not be provided to the ball.

It is necessary that the rubber center thus obtained is provided with a suitable impact resilience by mainly using a combination of the rubber/oily substance, as described above. The impact resilience is represented by the rebound height of the rubber center, measured by dropping it on a rigid surface such as concrete block from a height of 254 cm (100 inches) at 23° C. The impact resilience is preferably 90 cm or more. If the impact resilience is less than 90 cm, the resulting golf ball has low initial velocity and poor flying distance.

A thread rubber for a golf ball is wound around the rubber center to form a thread wound center comprising a center and a thread rubber layer, which is then covered with an outer cover material containing an ionomer resin or balata (transpolyisoprene) as a main component and molded in a mold provided with a dimple pattern. When the cover material containing balata as a main component is used, it is further vulcanized, pre-treated and finished with paint to obtain a desired golf ball.

As described above, according to the present invention, a thread wound golf ball having improved flight performances can be obtained by formulating an oily substance in a solid rubber center.

EXAMPLES

The following Examples further illustrate the present invention in detail but are not to be construed as limiting the scope thereof.

Examples 1 to 6 and Comparative Examples 1 to 3

A formulation shown in Table 1 was subjected to compression molding (vulcanization) at 155° C. for 20 minutes to make a rubber center having a diameter of about 28.4 mm. The weight of the resulting rubber center was 18.2 to 18.4 g. Then, a thread wound golf ball with an ionomer cover was made by a conventional method, using the rubber center. The flight performance of the resulting golf ball was evaluated by a conventional method. The results are shown in Table 2.

TABLE 1

| Component | Ex. 1 | Ex. 2 | Ex. 3 | Ex. 4 | Ex. 5 | Ex. 6 | Comp. Ex. 1 | Comp. Ex. 2 | Comp. Ex. 3 |
|---|---|---|---|---|---|---|---|---|---|
| BR21 (1) | 137.5 | — | — | — | — | — | — | — | — |
| BR11 (2) | — | — | — | — | — | — | 100 | — | — |
| Esprene 600F (3) | — | 100 | — | — | — | 100 | — | — | — |
| Esprene 505A (4) | — | 50 | — | — | — | — | — | 100 | — |
| Norsolex (5) | — | — | 100 | 100 | 100 | 50 | — | — | 100 |
| Sonic R-1000 (6) | 12.5 | — | — | — | — | — | — | — | — |
| Diana process oil PW-380 (70 | — | 100 | — | — | — | — | — | — | — |
| Sunthene 255ZJ (8) | — | — | 250 | — | — | 150 | — | — | — |
| Sunthene 450 (9) | — | — | — | 250 | — | — | — | — | — |
| Bansolve HS-4 (10) | — | — | — | — | 250 | — | — | — | — |
| Barium sulfate | 152 | 295 | 355 | 355 | 355 | 320 | 95 | 120 | 91 |
| Zinc oxide No. 3 | 5 | 5 | 5 | 5 | 5 | 5 | 5 | 5 | 5 |
| Stearic acid | 2 | 1 | 2 | 2 | 2 | 2 | 2 | 1 | 2 |
| Sulfur | 10 | 0.5 | 1.5 | 1.5 | 1.5 | 1.5 | 10 | 0.5 | 1.5 |
| Vulcanization accelerator CZ (11) | 1.5 | 1.5 | — | — | — | — | 1.5 | 1.5 | — |
| Vulcanization accelerator M (12) | — | 1.0 | 0.8 | 0.8 | 0.8 | 0.8 | — | 1.0 | 0.8 |
| Vulcanization accelerator TT (13) | 0.2 | 0.7 | 0.8 | 0.8 | 0.8 | 0.8 | 0.2 | 0.7 | 0.8 |
| Vulcanization accelerator TBT-N (14) | — | — | 1.2 | 1.2 | 1.2 | 1.2 | — | — | 1.2 |
| Vulcanization accelerator TE-G (15) | — | 0.5 | 0.4 | 0.4 | 0.4 | 0.4 | — | 0.5 | 0.4 |
| Vulcanization accelerator DPTT (16) | — | 0.5 | — | — | — | — | — | 0.5 | — |

(1) High-cis polybutadiene rubber manufactured by Nippon Synthetic Rubber Co. (37.5 Parts by weight of naphthene oil is added)

(2) High-cis polybutadiene rubber manufactured by Nippon Synthetic Rubber Co. (non oil, $M_{L1+4}$ = 43)

TABLE 1-continued

| Component | Ex. 1 | Ex. 2 | Ex. 3 | Ex. 4 | Ex. 5 | Ex. 6 | Comp. Ex. 1 | Comp. Ex. 2 | Comp. Ex. 3 |
|---|---|---|---|---|---|---|---|---|---|

(3) EPDM rubber manufactured by Sumitomo Chemical Co. (100 Parts by weight of paraffin oil is added)
(4) EPDM rubber manufactued by Sumitomo Chemical Co. (non oil, $M_{L1+4}$ (100° C.) = 45)
(5) Polynorbornene rubber commercially available from Nippon Zeon Hanbai Co. (manufactured by CdF Chimie Co., France)
(6) Naphthene oil manufactured by Kyoseki Co.
(7) Paraffinic oil manufactured by Idemitsu Kosan Co.
(8) Naphthenic oil manufactured by Nippon Sun Sekiyu Co.
(9) Naphthenic oil manufactured by Nippon Sun Sekiyu Co. (containing a large amount of aroma component)
(10) Alkylbenzene oil manufactured by Mitsubishi Yuka Co.
(11) N-cyclohexylbenzothiazylsulfene
(12) Mercaptobenzothiazole
(13) Tetramethylthiuram disulfide
(14) Tetrabutylthiuram disulfide particulate product
(15) Tellurium diethylthiocarbamate
(16) Dipentamethylene thiuram tetrasulfide

TABLE 2

| | Ex. 1 | Ex. 2 | Ex. 3 | Ex. 4 | Ex. 5 | Ex. 6 | Comp. Ex. 1 | Comp. Ex. 2 | Comp. Ex. 3 |
|---|---|---|---|---|---|---|---|---|---|
| Center impact resilience (cm) (4) | 180 | 140 | 120 | 105 | 140 | 130 | 215 | 80 | 10 |
| Ball weight (g) | 45.4 | 45.4 | 45.4 | 45.4 | 45.4 | 45.4 | 45.4 | 45.4 | 45.4 |
| Ball compression (1) | 86 | 86 | 85 | 85 | 85 | 85 | 86 | 86 | 87 |
| Flight performance A (2) | | | | | | | | | |
| Ball initial velocity (m/s) | 63.0 | 62.8 | 63.0 | 62.8 | 63.1 | 63.0 | 63.0 | 62.0 | 55.0 |
| Spin (rpm) | 3150 | 3100 | 3020 | 3010 | 3030 | 3050 | 3400 | 3450 | 3600 |
| Launch angle (°) | 11.2 | 11.3 | 11.5 | 11.5 | 11.5 | 11.4 | 10.5 | 10.4 | 10.0 |
| Carry (yard) | 223 | 222 | 224 | 223 | 225 | 224 | 217 | 212 | 180 |
| Total (yard) | 230 | 229 | 231 | 230 | 232 | 230 | 223 | 218 | 184 |
| Flight performances B (3) | | | | | | | | | |
| Ball initial velocity (m/s) | 54.2 | 54.2 | 54.2 | 54.0 | 54.3 | 54.1 | 54.2 | 53.1 | 47.0 |
| Spin (rpm) | 4100 | 4050 | 3970 | 3950 | 3980 | 4000 | 4400 | 4500 | 4800 |
| Launch angle (°) | 14.6 | 14.6 | 14.8 | 14.8 | 14.8 | 14.7 | 14.2 | 14.1 | 13.9 |
| Carry (yard) | 176 | 175 | 177 | 176 | 178 | 176 | 172 | 167 | 150 |
| Total (yard) | 179 | 178 | 180 | 179 | 181 | 179 | 175 | 170 | 152 |

(1) It is measured by PAG system.
(2) By using a swing-robot manufactured by Through Temper Co., a golf ball is hit at a head-club speed of 45 m/second with a No. 1 wood golf club to measure each value.
(3) By using a swing-robot manufactured by True Temper Co., a golf ball is hit at a head-club speed of 38 m/second with a No. 5 iron golf club to measure each value.
(4) A center is gravity-dropped from a height of 254 cm (100 inches) on a concrete block of about 6 cm in thickness to measure a rebound height (23° C.).

Examples 7 to 10 and Comparative Examples 4 to 6

A formulation shown in Table 3 was subjected to compression molding (vulcanization) at 155° C. for 20 minutes to make a rubber center having a diameter of about 28.4 mm. The weight of the resulting rubber center was 17 g. Then, a thread wound golf ball with a balata cover was made by a conventional method, using the rubber center. The flight performances of the resulting golf ball was evaluated by a conventional method. The results are shown in Table 4.

TABLE 4

| Component | Ex. 7 | Ex. 8 | Ex. 9 | Ex. 10 | Comp. Ex. 4 | Comp. Ex. 5 | Comp. Ex. 6 |
|---|---|---|---|---|---|---|---|
| BR21 | 137.5 | — | — | — | — | — | — |
| BR11 | — | — | — | — | 100 | — | — |
| Esprene 600F | — | 100 | — | — | — | — | — |
| Esprene 505A | — | 50 | — | — | — | 100 | — |
| Norsolex | — | — | 100 | 100 | — | — | 100 |
| Sonic R-1000 | 12.5 | — | — | — | — | — | — |
| Diana process oil PW-380 | — | 100 | — | — | — | — | — |
| Sunthene 255ZJ | — | — | 250 | — | — | — | — |
| SUnthene 450 | — | — | — | 250 | — | — | — |
| Barium sulfate | 120 | 240 | 190 | 190 | 75 | 96 | 71 |
| Zinc oxide No. 3 | 5 | 5 | 5 | 5 | 5 | 5 | 5 |
| Stearic acid | 2 | 1 | 2 | 2 | 2 | 1 | 2 |
| Sulfur | 10 | 0.5 | 1.5 | 1.5 | 10 | 0.5 | 1.5 |
| Vulcanization accelerator CZ | 1.5 | 1.5 | — | — | 1.5 | 1.5 | — |
| Vulcanization accelerator M | — | 1.0 | 0.8 | 0.8 | — | 1.0 | 0.8 |
| Vulcanization accelerator TT | 0.2 | 0.7 | 0.8 | 0.8 | 0.2 | 0.7 | 0.8 |
| Vulcanization accelerator TBT-N | — | — | 1.2 | 1.2 | — | — | 1.2 |
| Vulcanization accelerator TE-G | — | 0.5 | 0.4 | 0.4 | — | 0.5 | 0.4 |
| Vulcanization accelerator DPTT | — | 0.5 | — | — | — | 0.5 | — |
| Center impact resilience (cm) | 180 | 145 | 125 | 110 | 220 | 85 | 15 |
| Ball weight (g) | 45.5 | 45.4 | 45.5 | 45.5 | 45.5 | 45.4 | 45.4 |
| Ball compression (1) | 91 | 90 | 90 | 90 | 91 | 91 | 92 |
| Flight performances C (2) | | | | | | | |
| Ball initial velocity (m/s) | 62.8 | 62.6 | 62.8 | 62.6 | 62.8 | 61.7 | 54.0 |
| Spin (rpm) | 3500 | 3440 | 3400 | 3400 | 3950 | 3900 | 4200 |
| Launch angle (°) | 10.8 | 10.9 | 11.0 | 11.0 | 9.8 | 9.6 | 9.3 |
| Carry (yard) | 217 | 216 | 218 | 217 | 212 | 208 | 176 |
| Total (yard) | 224 | 224 | 225 | 224 | 216 | 211 | 180 |
| Flight performances D (3) | | | | | | | |
| Ball initial velocity (m/s) | 54.0 | 53.9 | 54.0 | 53.9 | 54.0 | 53.0 | 46.0 |
| Spin (rpm) | 4600 | 4500 | 4400 | 4400 | 5600 | 5600 | 6000 |
| Launch angle (°) | 13.5 | 13.5 | 13.8 | 13.8 | 12.6 | 12.3 | 11.9 |
| Carry (yard) | 173 | 173 | 174 | 173 | 167 | 162 | 143 |
| Total (yard) | 177 | 178 | 179 | 178 | 170 | 165 | 146 |

(1) It is measured by PAG system.
(2) By using a swing-robot manufactured by Through Temper Co., a golf ball is hit at a head-club speed of 45 m/second with a No. 1 wood golf club to measure each value.
(3) By using a swing-robot manufactured by True Temper Co., a golf ball is hit at a head-club speed of 38 m/second with a No. 5 iron golf club to measure each value.

As is apparent from the above results, the flying distance was extremely improved mainly by high hitting angle and low spin in a golf ball having an ionomer cover or balata cover.

Further, professional golfers were asked to hit the golf balls and their evaluations were asked. As a result, the golf balls of Examples 1 to 10 had excellent hit feeling and control properties.

What is claimed is:

1. A thread wound golf ball consisting essentially of:

(1) a solid center having a diameter of 23 to 34 mm, comprising a rubber component having a crosslinked structure and containing an oily substance, and having an impact resilience of 90 cm or more;

(2) a thread rubber layer; and (3) an outer cover, wherein the oily substance is present in an amount of 30 to 500 parts by weight based on 100 parts by weight of the rubber, wherein the rubber component is selected from the group consisting of polybutadiene rubber, natural rubber, ethylene-propylene-diene monomer (EPDM), polynorbomene rubber and urethane rubber, and if the rubber component is polybutadiene rubber or natural rubber, the oily substance is naphthenic oil or aromatic oil, if the rubber component is ethylene-propylene-diene monomer (EPDM), the oily substance is paraffin oil, if the rubber component is polynorbornene rubber, the oily substance is naphthenic oil, aromatic oil, plasticizer, alkylbenzene or paraffinic oil, and if the rubber component is urethane rubber, the oily substance is plasticizer.

2. The thread wound golf ball according to claim 1, wherein said rubber component consists of polynorbornene rubber and said oily substance consists of alkylbenzene oil.

3. The thread wound golf ball according to claim 1, wherein the solid center has a diameter of 26 to 32 mm.

4. The thread wound golf ball according to claim 1, wherein the rubber component is polybutadiene rubber or natural rubber.

5. The thread wound golf ball according to claim 1, wherein the rubber component is ethylene-propylene-diene monomer (EPDM).

6. The thread wound golf ball according to claim 1, wherein the rubber component is polynorbornene rubber.

7. The thread wound golf ball according to claim 1, wherein the rubber component is urethane rubber.

* * * * *